US010279880B2

(12) United States Patent
Namba et al.

(10) Patent No.: US 10,279,880 B2
(45) Date of Patent: May 7, 2019

(54) CONTROL DEVICE OF OUTBOARD MOTOR

(71) Applicant: SUZUKI MOTOR CORPORATION, Hamamatsu-shi, Shizuoka (JP)

(72) Inventors: Masahiro Namba, Hamamatsu (JP); Saharu Watanabe, Hamamatsu (JP); Kohei Yamamoto, Hamamatsu (JP); Nobuyuki Shomura, Hamamatsu (JP)

(73) Assignee: SUZUKI MOTOR CORPORATION, Shizuoka (JP)

( * ) Notice: Subject to any disclaimer, the term of this patent is extended or adjusted under 35 U.S.C. 154(b) by 0 days.

(21) Appl. No.: 15/970,520

(22) Filed: May 3, 2018

(65) Prior Publication Data

US 2018/0334234 A1 Nov. 22, 2018

(30) Foreign Application Priority Data

May 19, 2017 (JP) ..... 2017-099631

(51) Int. Cl.

| | |
|---|---|
| ***B63H 21/21*** | (2006.01) |
| ***B63H 23/08*** | (2006.01) |
| ***B63H 23/30*** | (2006.01) |
| ***B63H 21/17*** | (2006.01) |
| ***B63H 1/28*** | (2006.01) |
| *B63J 99/00* | (2009.01) |

(52) U.S. Cl.

CPC ..... *B63H 21/213* (2013.01); *B63H 1/28* (2013.01); *B63H 21/17* (2013.01); *B63H 23/08* (2013.01); *B63H 23/30* (2013.01); *B63H 2021/216* (2013.01); *B63J 2099/008* (2013.01)

(58) Field of Classification Search

CPC ..... B63H 21/21; B63H 2021/216; B63H 2021/213

See application file for complete search history.

(56) References Cited

U.S. PATENT DOCUMENTS 9,156,537 B1 * 10/2015 Nakayasu ..... B63H 25/06
2009/0215331 A1 * 8/2009 Suzuki ..... B63H 21/213 440/1

FOREIGN PATENT DOCUMENTS

JP 2009202686 A 9/2009

* cited by examiner

*Primary Examiner* — Andrew Polay
(74) *Attorney, Agent, or Firm* — Troutman Sanders LLP

(57) ABSTRACT

Disclosed is an control device of an outboard motor, including: a computation unit configured to set, as a starting point, a timing before a gearshift mechanism is shifted from forward to neutral after an accelerator opening level is fully closed in a case where an operator's manipulation is performed from forward to neutral, and compute a time-series change of an engine rotation speed as a simulated ship speed on the basis of the engine rotation speed detected by an engine rotation speed detector at the starting point; and a control unit configured to control an actuator such that, in a case where the operator's manipulation is performed from forward to reverse through neutral, the gearshift mechanism is maintained in the neutral position until the simulated ship speed estimated by the computation unit becomes a predetermined threshold value or lower, and is then shifted to reverse.

6 Claims, 5 Drawing Sheets

CONTROL DEVICE OF OUTBOARD MOTOR

CROSS-REFERENCE TO RELATED APPLICATIONS

This application is based upon and claims the benefit of priority of the prior Japanese Patent Application No. 2017-099631, filed on May 19, 2017, the entire contents of which are incorporated herein by reference.

BACKGROUND OF THE INVENTION

Field of the Invention

The present invention relates to a control device of an outboard motor.

Description of the Related Art

An outboard motor has a gearshift mechanism for shifting a gear position between forward, neutral, and reverse positions.

A ship mounted with such an outboard motor is decelerated or stops in response to a gearshift manipulation in some cases. For example, in order to decelerate or stop a ship, a thrust force reverse to a current travel direction of the ship is generated by reversing the current gear position.

However, when the current gear position is shifted reversely to the current position, a rotation direction of a propeller shaft is reversed around the gearshift operation. Therefore, a load is applied to a power source or a power transmission mechanism.

Patent Document 1 discusses a ship propelling system in which, when the gear position changes from a first gear position to a second gear position, and a control lever is operated such that a change rate of an accelerator opening level becomes a predetermined value or higher, an actuator maintains the first gear position until a propeller rotation speed becomes a predetermined rotation speed or lower, and then shifts to the gear position to the second gear position in order to reduce a load applied to the power source or the power transmission mechanism when reversing the gear position oppositely to the travel direction.

Patent Document 1: Japanese Laid-open Patent Publication No. 2009-202686

However, in the technique of Patent Document 1, it is necessary to mount a propeller rotation speed sensor for detecting a propeller rotation speed. In general, the propeller rotation speed sensor detects a rotation of a propeller shaft mounted with a propeller. The propeller shaft is disposed inside the gear casing, so that its front part is rotated in oil inside the gear casing, and its rear part mounted with the propeller is rotated in water. In addition, a shape (such as a frontal projected area) of the gear casing immersed in water during sailing significantly affects a maximum forward travel speed of the ship mounted with the outboard motor. Therefore, it is desirable to provide a compact shape of the gear casing. In this manner, when the propeller rotation speed sensor is mounted, a waterproof or sealing structure is indispensable in water or oil, and it is necessary to arrange the propeller rotation speed sensor by avoiding an exhaust passage or the like in the compact gear casing. Therefore, this is a heavy burden from the technical and costly viewpoints.

SUMMARY OF THE INVENTION

In view of the aforementioned problems, it is therefore an object of the invention to reduce a load of the power source or the power transmission mechanism in the event of a gearshift operation without necessity of a ship speed sensor or a propeller rotation speed sensor.

According to an aspect of the invention, there is provided a control device for controlling an outboard motor having a power source, a propeller driven by a rotation force of the power source, a gearshift mechanism serving as a part of a power transmission mechanism between the power source and the propeller and shifting a gear position to a forward position, a neutral position, and a reverse position, and an actuator configured to drive the gearshift mechanism, the control device comprising: an input means configured to input a gear position caused by an operator's manipulation, an accelerator opening level caused by an operator's manipulation or a throttle valve opening level controlled depending on the accelerator opening level (hereinafter, collectively referred to as an accelerator opening level), and a rotation speed of the power source; a computation means configured to set, as a starting point, a timing before the gearshift mechanism is shifted from the forward position to the neutral position after the accelerator opening level is fully closed in a case where the operator's manipulation is a manipulation from the forward position to the neutral position, and compute a time-series change of a rotation speed of the power source as a simulated ship speed on the basis of the rotation speed of the power source at the starting point; and a control means configured to control the actuator such that, in a case where the operator's manipulation is a manipulation from the forward position to the reverse position through the neutral position, the gearshift mechanism is maintained in the neutral position until the simulated ship speed computed by the computation means becomes a predetermined threshold value or lower, and the gearshift mechanism is then shifted to the reverse position.

DETAILED DESCRIPTION OF THE PREFERRED EMBODIMENTS

An outboard motor control device according to an embodiment of the invention is a control device for controlling an outboard motor having a power source, a propeller driven by a rotation force of the power source, a gearshift mechanism serving as a part of a power transmission mechanism between the power source and the propeller and shifting a gear position between a forward position, a neutral position, and a reverse position, and an actuator configured to drive the gearshift mechanism, the control device including: an input means configured to input a gear position caused by an operator's manipulation, an accelerator opening level caused by an operator's manipulation or a throttle valve opening level controlled depending on the accelerator opening level (hereinafter, collectively referred to as an accelerator opening level), and a rotation speed of the power source; a computation means configured to set, as a starting point, a timing before the gearshift mechanism is shifted from the forward position to the neutral position after the accelerator opening level is fully closed in a case where the operator's manipulation is a manipulation from the forward position to the neutral position, and compute a time-series change of a rotation speed of the power source as a simulated ship speed on the basis of the rotation speed of the power source at the starting point; and a control means configured to control the actuator such that, in a case where the operator's manipulation is a manipulation from the forward position to the reverse position through the neutral position, the gearshift mechanism is maintained in the neutral position until the simulated ship speed computed by the computation means becomes a predetermined threshold value or lower, and the gearshift mechanism is then shifted to the reverse position. In this manner, the time-series change of the simulated ship speed that depends on a real ship speed is estimated and computed, and the gearshift mechanism is shifted to the reverse position when the simulated ship speed becomes the predetermined threshold value or lower. Therefore, it is possible to reduce a load applied to the power source or the power transmission mechanism in the event of a gearshift operation without necessity of the ship speed sensor or the propeller rotation speed sensor.

Embodiments

Preferable embodiments of the invention will now be described with reference to the accompanying drawings.

Figure 1:
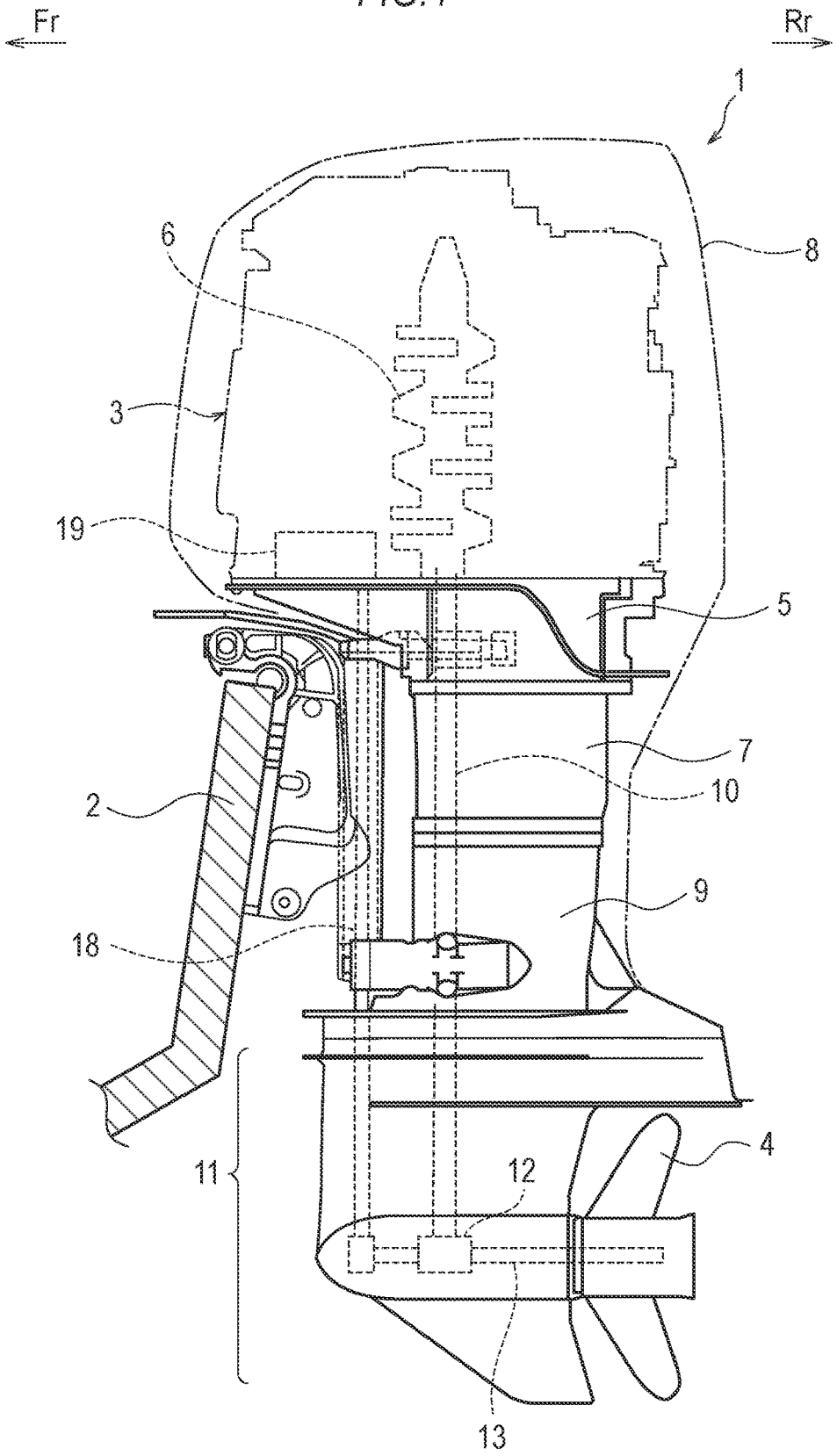
FIG. 1 is a left side view illustrating an outboard motor.

At first, an exemplary outboard motor to which the invention can be applied will be described. FIG. 1 is a left side view illustrating the outboard motor 1. The outboard motor 1 is installed in a transom of a tail of a ship hull 2 to transmit a rotation fore of the engine 3 as a power source to a propeller 4 via a power transmission mechanism and generate a thrust force of the ship. Note that, in each drawing, the front side will be denoted by "Fr," and the rear side will be denoted by "Rr" as necessary.

As illustrated in FIG. 1, the outboard motor 1 has an engine holder 5, and an engine 3 is provided over the engine holder 5. The engine 3 is, for example, a water-cooled four-cycle four-cylinder engine as an internal combustion engine and also a vertical engine in which a crankshaft 6 is disposed substantially vertically. An oil pan 7 is provided under the engine holder 5. The engine 3, the engine holder 5, the oil pan 7, and the like of the outboard motor 1 are covered by an engine cover 8.

A driveshaft housing 9 is provided under the oil pan 7. The driveshaft 10 is substantially vertically arranged inside the engine holder 5, the oil pan 7, and the driveshaft housing 9. The driveshaft 10 has an upper end connected to a lower end of the crankshaft 6 and a lower end extending to a propelling unit 11 provided with a gear casing and provided in a lower part of the driveshaft housing 9.

Figure 2:
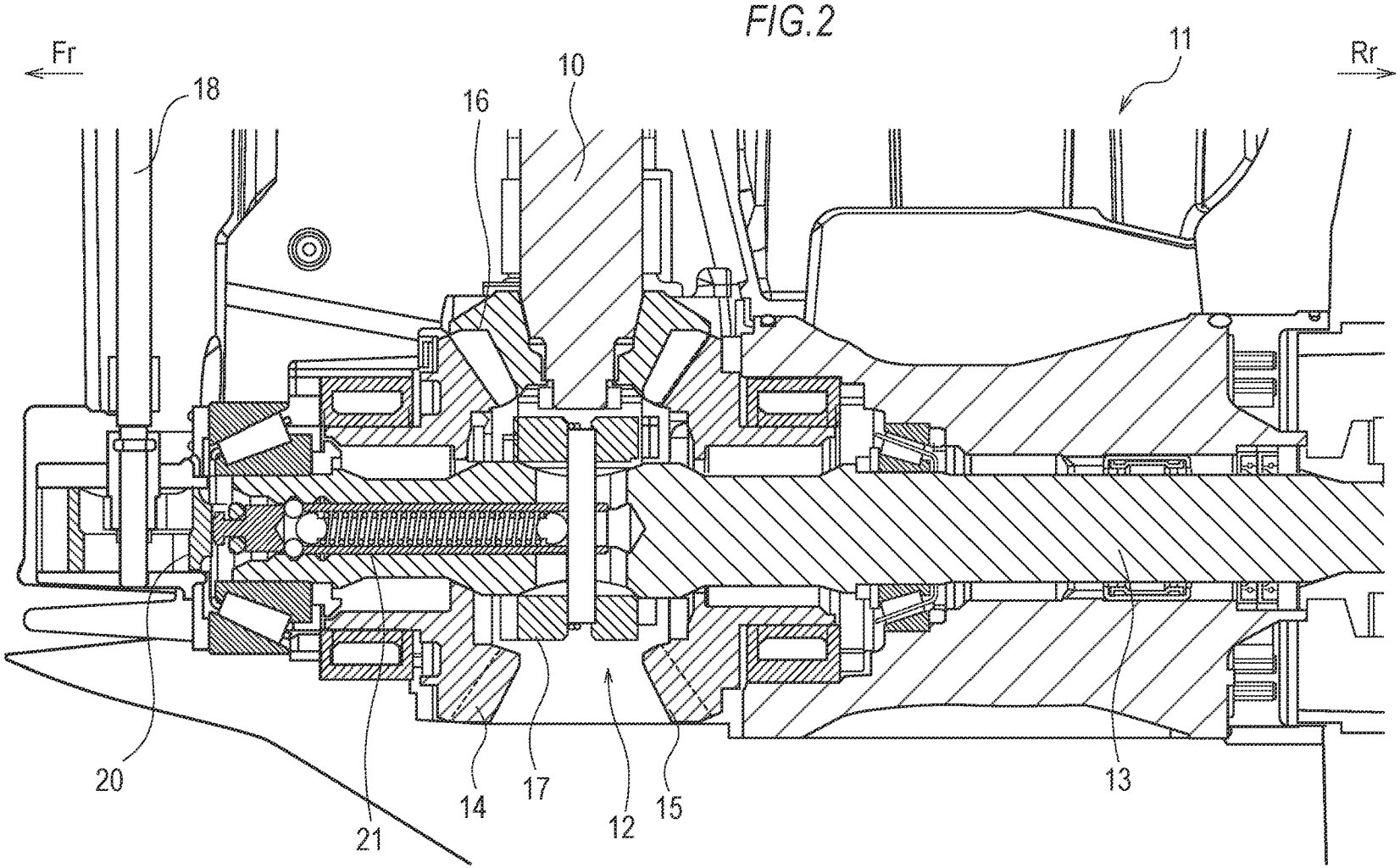
FIG. 2 is a cross-sectional view illustrating a propelling unit of the outboard motor.

FIG. 2 illustrates a cross section of the propelling unit 11. Inside the gear casing of the propelling unit 11, the propeller shaft 13 is arranged to extend in the front-rear direction and is rotatably supported. The propeller 4 is mounted in the rear end of the propeller shaft 13.

In the propelling unit 11, the driveshaft 10 is connected to the propeller shaft 13 via the gearshift mechanism 12. Specifically, under the driveshaft 10, a pair of front and rear gears 14 and 15 are rotatably supported while being inserted concentrically to the propeller shaft 13 and floatably. The front and rear gears 14 and 15 mesh with a bevel gear 16 fixed to the lower end of the driveshaft 10 at all times. In addition, a dog clutch 17 is disposed between the front and rear gears 14 and 15. The dog clutch 17 has a substantially hollowed cylindrical shape, is rotated in synchronization with the propeller shaft 13, and is slidable along its axial direction by a predetermined stroke with respect to the propeller shaft 13. The dog clutch 17 is engaged with the front gear 14 by sliding to the front side from the neutral position and is rotated in synchronization with the front gear 14. In addition, the dog clutch 17 is engaged with the rear gear 15 by sliding to the rear side and is rotated in synchronization with the rear gear 15.

A gearshift rod 18 is substantially vertically disposed in front of the driveshaft 10. The gearshift rod 18 has an upper end connected to an electric actuator 19 disposed adjacent to the engine 3 and a lower end extending to the inside of the propelling unit 11. A gearshift yoke (not shown) as a cam integrally protrudes from the lower end of the gearshift rod 18. The gearshift rod 18 is engaged with a gearshift slider 20 arranged coaxially with the propeller shaft 13 by interposing the gearshift yoke. As the gearshift rod 18 is rotated to the left and right around the axis, the gearshift yoke presses the gearshift slider 20, so that the gearshift slider 20 slides to the front or the rear. The gearshift slider 20 is connected to the dog clutch 17 via a connector rod 21 arranged to axially penetrate through the propeller shaft 13. Therefore, the dog clutch 17 slides to the front or the rear in synchronization of the front or rear sliding of the gearshift slider 20.

In this manner, as the gearshift slider 20 and the connector rod 21 slide to the front or the rear by selectively rotating the gearshift rod 18 from the neutral position to the left or the right using the electric actuator 19, the dog clutch 17 is engaged with or disengaged from the front or rear gear 14 or 15, so that it is possible to shift the gearshift mechanism 12 to a forward position (forward travel), a neutral position, or a reverse position (reverse travel).

<Electronic Gearshift Control System>

Figure 3:
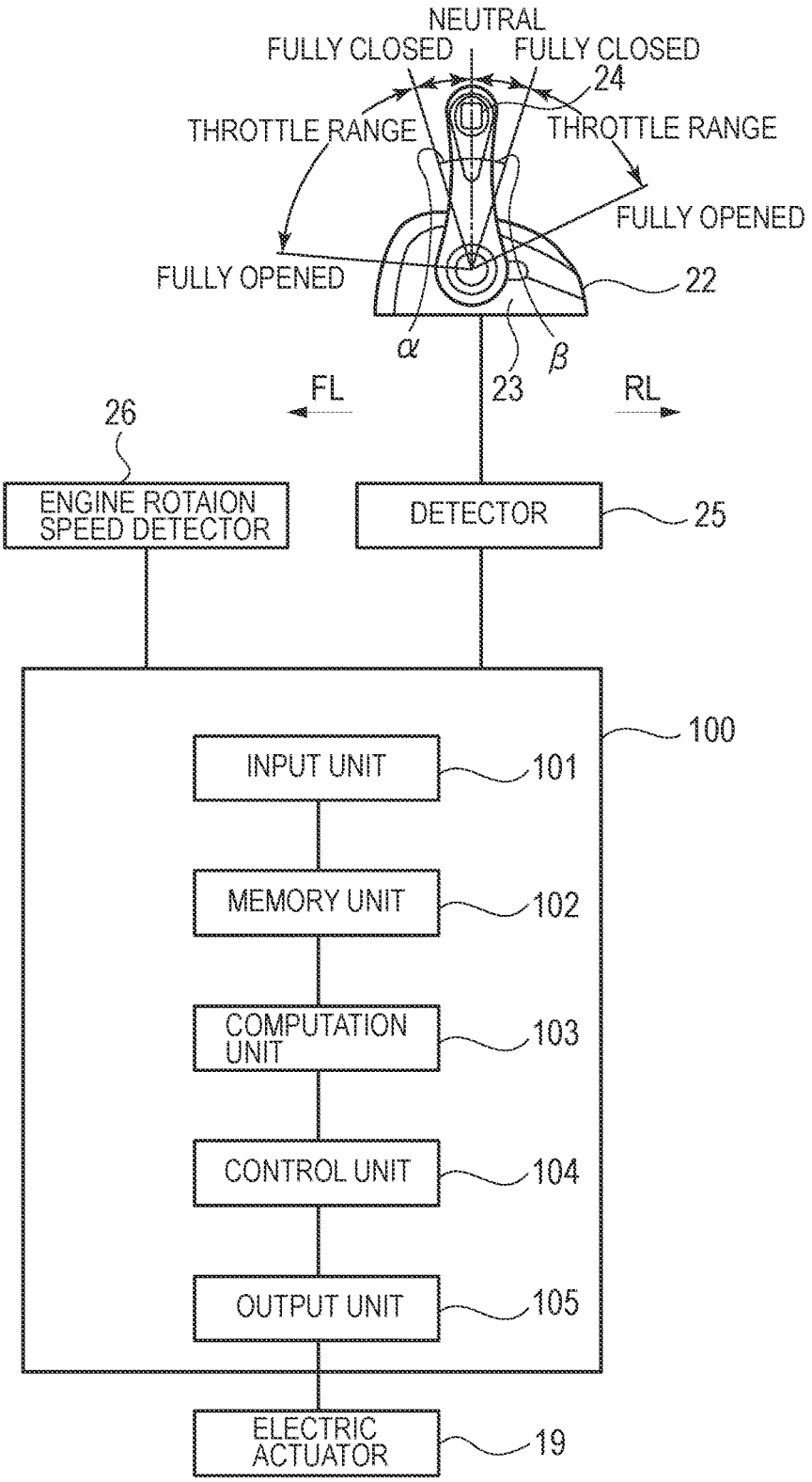
FIG. 3 is a diagram illustrating an exemplary configuration of an electronic gearshift control system.

Next, an electronic gearshift control system for controlling shifting of the gear position of the gearshift mechanism 12 of the outboard motor 1 will be described with reference to FIG. 3. In the following description, the gear position of the gearshift mechanism 12 will also be referred to as a real gear position.

The ship hull 2 is provided with a remote controller 22. The remote controller 22 has a control box 23 and a manipulation lever 24. As the manipulation lever 24 is pushed to the front side from the neutral position, a gearshift manipulation to the forward position is performed. As the manipulation lever 24 is pulled to the rear side, a gearshift manipulation to the reverse position is performed. More specifically, the manipulation to the front side from the neutral position is a forward gear position, and the accelerator opening level changes from a fully closed state to a fully opened state depending on a manipulation level of the manipulation lever 24 within a throttle range over an angle range $\alpha$. Similarly, the manipulation to the rear side from the neutral position is a reverse gear position, and the accelerator opening level changes from a fully closed state to a fully opened state depending on a manipulation level of the manipulation lever 24 within a throttle range over an angle range $\beta$. A position of the manipulation lever 24, that is, the gear position and the accelerator opening level caused by the gearshift manipulation using the remote controller 22 is detected by a detector 25.

The control device 100 controls the electric actuator 19 in response to a gearshift manipulation of the remote controller 22 to shift the real gear position. The control device 100 is implemented, for example, by an engine control unit (ECU) that comprehensively controls the engine 3. However, herein, only functional elements necessary as an outboard motor control device according to the invention are illustrated, and other parts are not illustrated for simplicity purposes. The ECU changes a throttle valve opening level, a fuel injection amount, or the like on the basis of the accelerator opening level caused by the gearshift manipulation using the remote controller 22 to control the output power of the engine 3.

In the control device 100, the input unit 101 receives a gear position and the accelerator opening level caused by a gearshift manipulation detected by the detector 25. Although the accelerator opening level caused by the operator's manipulation is input in this embodiment, alternatively, a throttle valve opening level detected by a throttle valve opening level detector (not shown) may also be input. The throttle valve opening level is controlled by the ECU to follow the accelerator opening level. In addition, the input unit 101 receives a rotation speed of the engine 3 (hereinafter, referred to as an engine rotation speed) detected by an engine rotation speed detector 26.

The memory unit 102 stores a damping gain used when the computation unit 103 estimates and computes the simulated ship speed.

AS described below in details, in a case where the gearshift manipulation detected by the detector 25 is a manipulation from the forward position to the neutral position, the computation unit 103 sets, as a starting point, a timing before the gearshift mechanism 12 shifts the gear position from the forward position to the neutral position after the accelerator opening level is fully closed, and estimates and computes a time-series change of the rotation speed of the engine 3 as a simulated ship speed on the basis of the engine rotation speed detected by the engine rotation speed detector 26 at the starting point. More specifically, a timing that an absolute value ΔNE of a change rate of the engine rotation speed detected by the engine rotation speed detector 26 after the accelerator opening level is fully closed (an absolute value of a change amount of the engine rotation speed per unit time) initially becomes a predetermined threshold value or lower is set as the starting point. The simulated ship speed is estimated and computed on the basis of a previous value (initially, the engine rotation speed at the starting point), a time elapsing from the previous computation, and a damping gain stored in the memory unit 102.

The control unit 104 shifts a real gear position by controlling the electric actuator 19 on the basis of the gearshift manipulation detected by the detector 25. In this case, as described below in details, in a case where the gearshift manipulation detected by the detector 25 is a manipulation from the forward position to the reverse position through the neutral position, the control unit 104 controls the electric actuator 19 such that the gearshift mechanism 12 maintains the neutral position until the simulated ship speed estimated computation by the computation unit 103 becomes a predetermined threshold value or lower, and is then shifted to the reverse position.

The output unit 105 outputs a drive signal to the electric actuator 19 under control of the control unit 104. As a result, the electric actuator 19 is driven, and the gearshift mechanism 12 shifts the gear position between the forward, neutral, and the reverse positions.

In the electronic gearshift control system described above, the gearshift operation is performed under control of the control device 100 without mechanically connecting the remote controller 22 and the gearshift mechanism 12 of the outboard motor 1. Therefore, it is possible to freely control a shift timing of a real gear position for a gearshift manipulation of the remote controller 22.

An electronic gearshift control of the electronic gearshift control system according to an embodiment will now be described in details.

Since a ship is not provided with a device corresponding to a brake of an automobile or the like, a gearshift manipulation is performed from the forward position to the neutral position when it is desired to decelerate or stop the ship during forward sailing. Depending on a situation, in order to generate a thrust force reverse to a travel direction of a ship, the gearshift manipulation may be made from the forward position to the reverse position through the neutral position. Specifically, the manipulation lever 24 of the remote controller 22 is manipulated from a forward pushed state, to the neutral position, and to a backward pulled state.

In order to shift the real gear position from the forward position to the reverse position through the neutral position without a time delay when the gearshift manipulation is performed from the forward position to the reverse position through the neutral position during forward sailing in this way, an excessive load is applied to the engine 3 or the power transmission mechanism. This may degrade durability of the power transmission mechanism or generate an engine stall.

In this regard, according to this embodiment, when the gearshift manipulation is performed from the forward position to the reverse position through the neutral position during forward sailing, degradation of durability of the power transmission mechanism or an engine stall is prevented by controlling a timing for shifting the real gear position to the reverse position.

Figure 4:
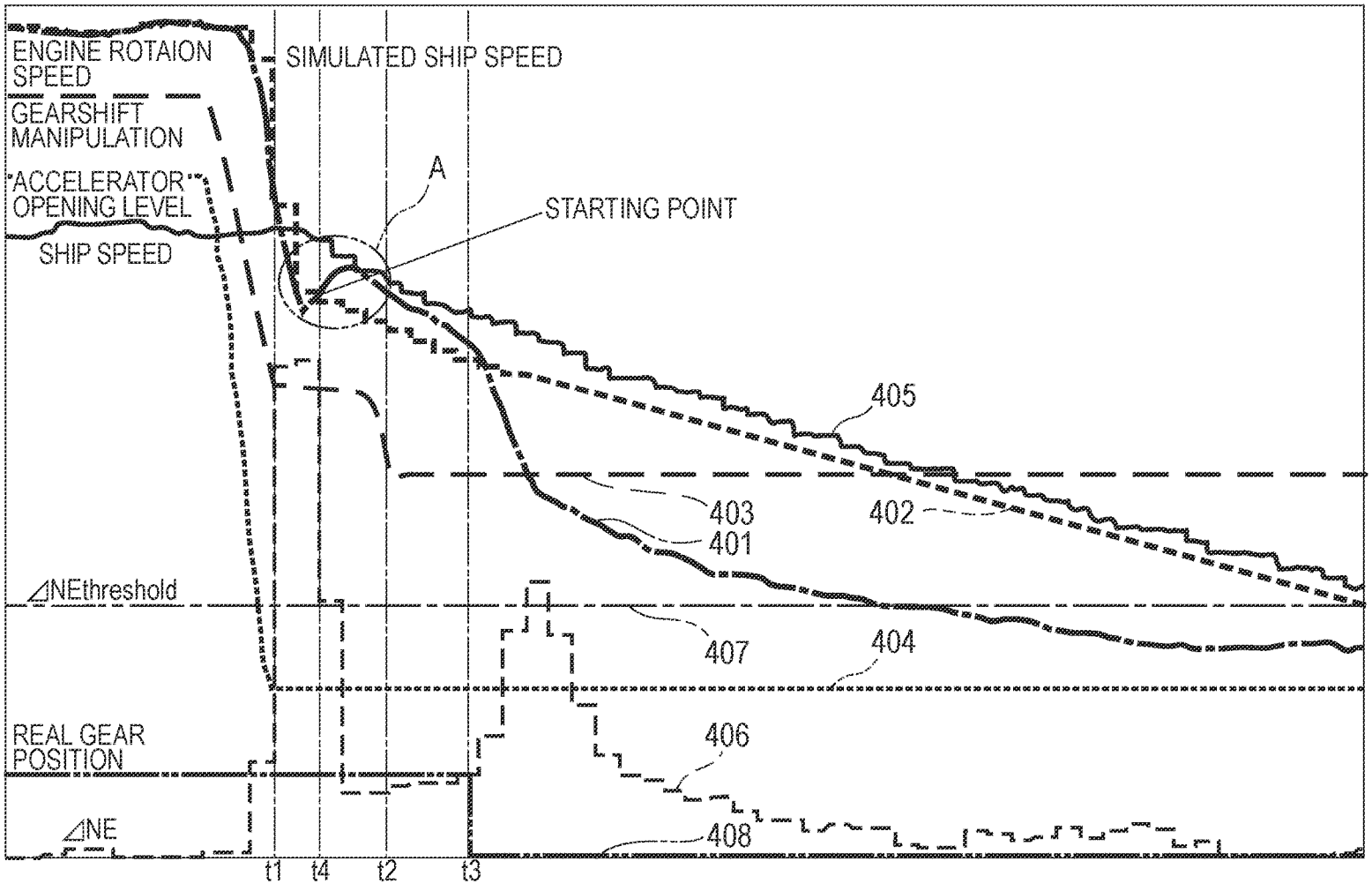
FIG. 4 is a characteristic diagram illustrating time-series changes of various characteristics when a gear position is shifted from a forward position to a neutral position during forward sailing.

FIG. 4 illustrates time-series changes of various characteristics when the gearshift manipulation is performed from the forward position to the neutral position during forward sailing. Specifically, FIG. 4 illustrates time-series changes of characteristics including an engine rotation speed 401, a simulated ship speed 402, a gearshift manipulation 403, an accelerator opening level 404, a ship speed 405, ΔNE 406, ΔNE threshold value 407, and a real gear position 408.

As illustrated in FIG. 4, at the timing $t_1$ in the middle of the gearshift manipulation 403 from the forward position to the neutral position, the accelerator opening level 404 is fully closed. At the timing $t_2$, the gear position caused by the gearshift manipulation 403 becomes neutral.

As the gear position becomes neutral in response to the gearshift manipulation 403, the electric actuator 19 is driven under control of the control unit 104, so that, at the timing $t_3$, the real gear position 408 is shifted from the forward position to the neutral position. From the timing $t_2$ at which the gear position caused by the gearshift manipulation 403 becomes neutral to the timing $t_3$ at which the real gear position 408 becomes neutral, a time lag occurs in an operation time of the electric actuator 19 or the gearshift mechanism 12, or the like.

As illustrated in FIG. 4, as the accelerator opening level 404 becomes a closed direction during forward sailing, the engine rotation speed 401 decreases depending on the accelerator opening level 404. In addition, although the ship speed 405 decreases due to a water resistance (displacement resistance) applied to the ship hull 2, a decrease of the ship speed 405 is negligible, compared to a decrease of the engine rotation speed 401. Since the ship continues to sail forward, a water stream caused by the forward sailing of the ship is applied to the propeller 4, and the propeller 4 is continuously rotated in the forward direction.

Here, during forward sailing in which the real gear position 408 is in the forward position, and the propeller 4 is driven by virtue of a rotation force of the engine 3 depending on the accelerator opening level 404 (before the timing $t_1$), a ratio between the engine rotation speed 401 and the rotation speed of the propeller shaft 13 depends on a gear ratio therebetween. In addition, during the forward sailing, a slip occurs between the propeller 4 and the surrounding water. Depending on a state of the slip, a relationship between the engine rotation speed 401 and the ship speed 405 is weak. In addition, depending on a situation, the engine rotation speed 401 and the ship speed 405 may lose the relationship therebetween.

If the accelerator opening level 404 is fully closed while the real gear position 408 remains in the forward position during forward sailing (timing $t_1$), the propeller 4 starts engaged rotation. That is, the propeller 4 rotates the engine 3 (crankshaft 6) by virtue of a rotation force caused by a water stream applied to the propeller 4 depending on the ship speed 405. Since the propeller 4 is rotated by virtue of a water stream when the propeller 4 performs the engaged rotation, a slip with water is removed, so that a relationship between the engine rotation speed 401 and the ship speed 405 becomes strong, and a decrease of the engine rotation speed 401 depends on a decrease of the ship speed 405.

Then, if the real gear position 408 is shifted from the forward position to the neutral position (after the timing $t_3$), the engaged rotation of the propeller 4 does not occur, so that the engine rotation speed 401 abruptly decreases, and a relationship between the engine rotation speed 401 and the ship speed 405 is removed.

From this viewpoint, in a case where the gearshift manipulation 403 detected by the detector 25 is a manipulation from the forward position to the neutral position, a time-series change of the subsequent simulated ship speed 402 is estimated and computed on the basis of the engine rotation speed 401 associated with the ship speed 405, that is, the engine rotation speed 401 at the timing at which the propeller 4 starts the engaged rotation. As a result, as illustrated in FIG. 4, the simulated ship speed 402 after the real gear position 408 is shifted from the forward position to the neutral position (after the timing $t_3$) can be estimated on the basis of a relationship with the ship speed 405.

The timing at which the propeller 4 starts engaged rotation is obtained in the following way. As illustrated in FIG. 4, if the gearshift manipulation 403 is performed from the forward position to the neutral position during forward sailing, the engine rotation speed 401 abruptly decreases. However, if the propeller 4 starts the engaged rotation after the accelerator opening level 404 is fully closed (timing $t_1$), the engine rotation speed 401 smoothly decreases (region A in FIG. 4). In this regard, it is assumed that the propeller 4 starts the engaged rotation at the timing $t_4$ at which an absolute value of the change rate ΔNE 406 of the engine rotation speed 401 detected by the engine rotation speed detector 26 after the accelerator opening level 404 is fully closed initially becomes a predetermined threshold value ΔNEthreshold 407 or lower, and the timing t4 is set as a starting point.

Figure 5:
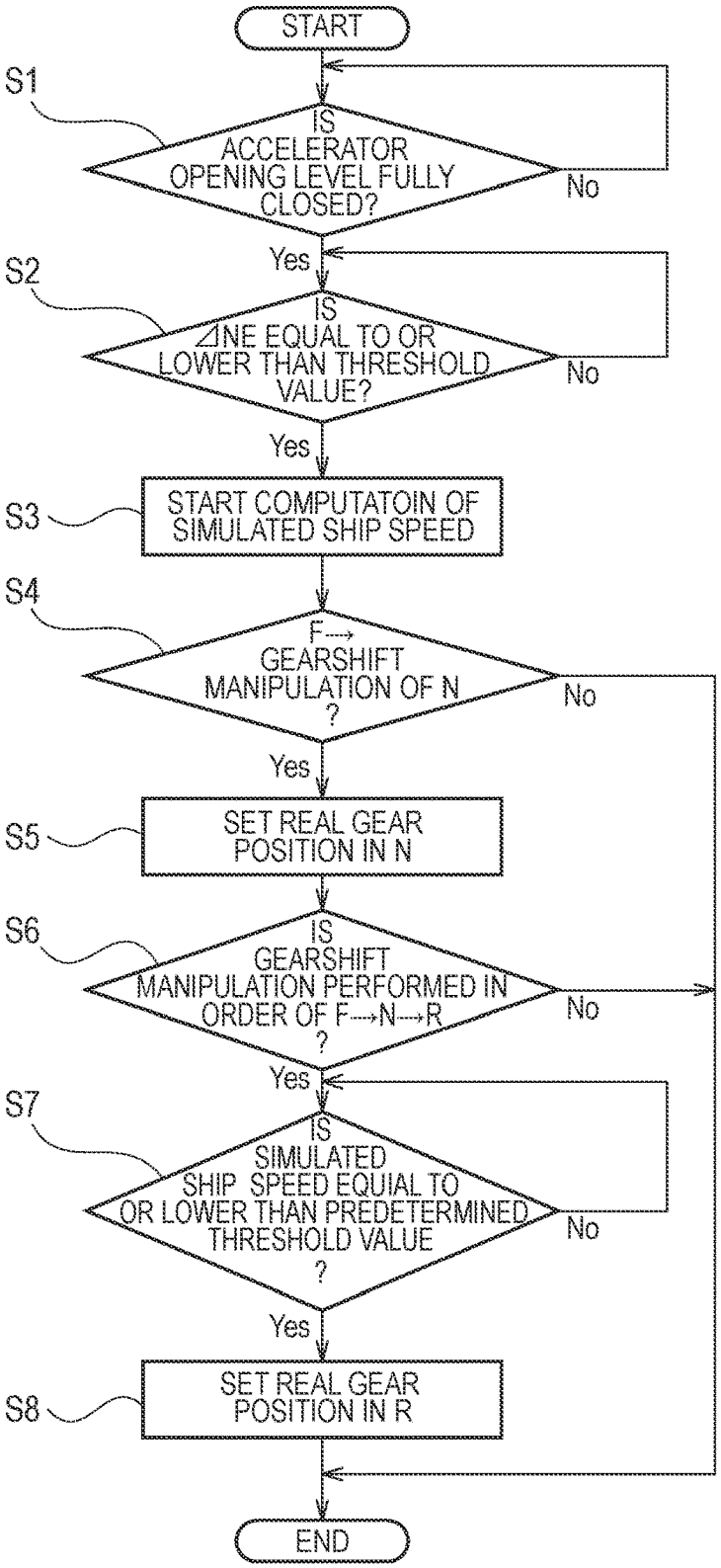
FIG. 5 is a flowchart illustrating an exemplary electronic gearshift control using a control device.

FIG. 5 is a flowchart illustrating an exemplary electronic gearshift control using the control device 100. The operation of the flowchart of FIG. 5 starts when the gearshift manipulation detected by the detector 25 is a manipulation from the forward position to the neutral position. Alternatively, in addition to the condition that the gearshift manipulation is a manipulation from the forward position to the neutral position, the operation of the flowchart of FIG. 5 may start, for example, when the manipulation is immediate deceleration. For example, a manipulation speed of the manipulation lever 24 may be detected, and the immediate deceleration may be determined when the detected manipulation speed becomes a predetermined level or higher.

In step S1, the computation unit 103 waits for the timing at which the accelerator opening level is fully closed. Then, when the accelerator opening level is fully closed, the process advances to step S2. This process may be skipped if the accelerator opening level is not fully closed even when a predetermined time elapses from the start of this flowchart, or if the gearshift manipulation detected by the detector 25 is not a manipulation from the forward position to the neutral position.

In step S2, the computation unit 103 waits for the timing at which an absolute value of the change rate ΔNE of the engine rotation speed detected by the engine rotation speed detector 26 becomes a threshold value ΔNEthreshold or smaller. When the absolute value of the change rate ΔNE becomes the threshold value ΔNEthreshold or smaller, the process advances to step S3. The threshold value ΔNEthreshold is set by performing a test operation or the like in advance.

In step S3, the computation unit 103 sets the timing at which the absolute value of the change rate ΔNE of the engine rotation speed becomes the threshold value ΔNEthreshold or smaller as the starting point, and estimates and computes a time-series change of the rotation speed of the engine 3 as the simulated ship speed on the basis of the engine rotation speed detected by the engine rotation speed detector 26 at the starting point.

As expressed in Formula (1), the simulated ship speed is estimated and computed on the basis of a previous value (an initial value is the engine rotation speed at the starting point), an elapsing time Δt from the previous computation, and a damping gain "a" [rpm/s] stored in the memory unit 102. The estimated computation of the simulated ship speed is performed on a predetermined time interval basis (for example, 100 [ms]).

$$\text{simulated ship speed} = \text{previous value} + a \times \Delta t \quad (1)$$

For example, as shown in Table 1, the memory unit 102 stores the damping gains "a" in association with a plurality of engine rotation speed regions ranging from an idling rotation speed of the engine 3 to the maximum rotation speed. The damping gain "a" represents a falling gradient of the engine rotation speed when the accelerator opening level is fully closed, and the propeller 4 performs engaged rotation. The damping gain "a" is set depending on the previous engine rotation speed. For example, if the previous engine rotation speed is 3,000 [rpm] or higher and lower than 4,000 [rpm], the damping gain "a" becomes −48.4 (this means the engine rotation speed decreases by −48.4 [rpm] per one second). Since the damping gain "a" is different depending on a ship hull or an outboard motor, for example, the damping gains "a" obtained through a learning control are set in advance for each ship. Note that a median value of the engine rotation speed may be obtained through linear interpolation of the damping gain "a." For example, in the case of Table 1, if the previous engine rotation speed is 5,500 [rpm], the damping gain "a" may be set to "(−88+(−90))/2=−89."

TABLE 1

| Gain "a" (rpm/s) | | | | | | |
|---|---|---|---|---|---|---|
| 700 | 1000 | 2000 | 3000 | 4000 | 5000 | 6000 |
| −11 | −22 | −36.3 | −48.4 | −72.6 | −88 | −90 |

Although steps S4 and S5 are illustrated below step S3 in FIG. 5, steps S4 and S5 are executed together with steps S2 and S3. In step S4, the control unit 104 determines whether or not the gearshift manipulation detected by the detector 25 is a gearshift manipulation to the neutral position. If it is the gearshift manipulation to the neutral position, the process advances to step S5. Otherwise, this process is skipped. In step S5, the control unit 104 controls the electric actuator 19 to shift the real gear position from the forward position to the neutral position. Note that, although steps S4 and S5 are executed together with steps S2 and S3, step S3 is executed before the real gear position is shifted to the neutral position because a time lag occurs from the timing at which the gear position caused by the gearshift manipulation becomes neutral to the timing at which the real gear position becomes neutral as described above.

In step S6, the control unit 104 determines whether or not the gearshift manipulation detected by the detector 25 is a gearshift manipulation from the forward position to the reverse position through the neutral position. If it is the gearshift manipulation from the forward position to the reverse position through the neutral position, the process advances to step S7. Otherwise, this process is skipped.

In step S7, the control unit 104 waits for a timing at which the simulated ship speed obtained in the estimation and computation starting in step S3 becomes a predetermined threshold value or lower. When the simulated ship speed becomes the predetermined threshold value or lower, the process advances to step S8.

In step S8, the control unit 104 controls the electric actuator 19 such that the real gear position is shifted from the neutral position to the reverse position.

Note that, although the timing at which the gearshift manipulation is performed from the forward position to the neutral position during forward sailing is illustrated in FIG. 4 for simplicity purposes, this similarly applies to a behavior of the simulated ship speed when the gearshift manipulation is performed from the forward position to the reverse position through the neutral position during forward sailing. In addition, the gearshift mechanism 12 is maintained in the neutral position until the simulated ship speed becomes a predetermined threshold value or lower. Then, the gearshift mechanism 12 is shifted to the reverse position.

As described above, the simulated ship speed associated with the real ship speed is estimated and computed when the gearshift manipulation is performed from the forward position to the reverse position through the neutral position during forward sailing. The real gear position is shifted to the reverse position when the simulated ship speed becomes a predetermined threshold value or lower. As a result, it is possible to reduce a load applied to the engine 3 or the power transmission mechanism in the gearshift operation without necessity of a ship speed sensor or a propeller rotation speed sensor.

While embodiments of the invention have been described in details hereinbefore with reference to the accompanying drawings, it should be noted that the aforementioned embodiments merely illustrate concrete examples of implementing the present invention, and the technical scope of the present invention is not to be construed in a restrictive manner by these embodiments. That is, the present invention may be implemented in various forms without departing from the technical spirit or main features thereof, and they are also included in the scope of the invention.

Although the damping gains are set for a plurality of engine rotation speed regions in the aforementioned embodiment, the damping gain may be set to a single value.

Although the damping gain "a" is set in advance and is stored in the memory unit 102 in the aforementioned embodiment, the invention is not limited thereto. As described above, the engine rotation speed and the ship speed are associated with each other until the real gear position is shifted from the forward position to the neutral position (timing $t_4$ to $t_3$) from the starting point (that is, from the start of the engaged rotation of the propeller 4). In this regard, a calculation means configured to calculate a falling gradient [rpm/s] of the previous engine rotation speed may be provided, so that the time-series change of the subsequent simulated ship speed is estimated and computed by setting the falling gradient of the engine rotation speed as the damping gain "a." In this case, since the falling gradient of the engine rotation speed is calculated every time, it is possible to estimate and compute the simulated ship speed by setting the damping gain "a" suitable for a state of the ship hull at all times even when a water resistance varies due to dirt on a ship bottom or the like.

Although the propeller 4 starts the engaged rotation during the time lag until the real gear position becomes neutral in the aforementioned embodiment, the invention is not limited thereto. The real gear position may be actively maintained in the forward position until the propeller 4 starts the engaged rotation (that is, the absolute value of the change rate ΔNE of the engine rotation speed detected by the engine rotation speed detector 26 becomes the threshold value ΔNEthreshold or lower). Then, the real gear position may be shifted to the neutral position.

Note that the control device of the outboard motor according to the invention is implemented, for example, by using an information processing device provided with a central processing unit (CPU), a read-only memory (ROM), a random access memory (RAM), and the like and allowing the CPU to execute a predetermined program.

According to the present invention, it is possible to reduce a load applied to a power source or a power transmission mechanism in the event of a gearshift operation without necessity of a ship speed sensor or a propeller rotation speed sensor.

What is claimed is:

1. A control device for controlling an outboard motor including a power source, a propeller driven by a rotation force of the power source, a gearshift mechanism serving as a part of a power transmission mechanism between the power source and the propeller and shifting a gear position to a forward position, a neutral position, and a reverse position, and an actuator configured to drive the gearshift mechanism, the control device comprising:

a processor configured to:

receive a gear position caused by an operator's manipulation, an accelerator opening level caused by an operator's manipulation or a throttle valve opening level controlled depending on the accelerator opening level (hereinafter, collectively referred to as an accelerator opening level), and a rotation speed of the power source;

set, as a starting point, a timing before the gearshift mechanism is shifted from the forward position to the neutral position after the accelerator opening level is fully closed in a case where the operator's manipulation is a manipulation from the forward position to the neutral position, and compute a time-series change of a rotation speed of the power source as a simulated ship speed on the basis of the rotation speed of the power source at the starting point; and control the actuator such that, in a case where the operator's manipulation is a manipulation from the forward position to the reverse position through the neutral position, the gearshift mechanism is maintained in the neutral position until the simulated ship speed becomes a predetermined threshold value or lower, and the gearshift mechanism is then shifted to the reverse position, wherein the processor is configured to perform the computation on the basis of a previous value of the simulated ship speed, an elapsing time from the previous computation, and a damping gain representing a falling gradient of the rotation speed of the power source.

2. The control device of the outboard motor according to claim 1, wherein the processor is configured to set, as the starting point, a timing at which an absolute value of a change rate of the rotation speed of the power source after the accelerator opening level is fully closed initially becomes a predetermined threshold value or lower.

3. The control device of the outboard motor according to claim 1, further comprising a memory configured to store the damping gain set in advance.

4. The control device of the outboard motor according to claim 2, further comprising a memory configured to store the damping gain set in advance.

5. The control device of the outboard motor according to claim 1, wherein the processor is configured to calculate a falling gradient of the rotation speed of the power source until the gearshift mechanism is shifted from the forward position to the neutral position from the starting point, wherein the falling gradient is set as the damping gain.

6. The control device of the outboard motor according to claim 2, wherein the processor is configured to calculate a falling gradient of the rotation speed of the power source until the gearshift mechanism is shifted from the forward position to the neutral position from the starting point, wherein the falling gradient is set as the damping gain.

* * * * *